US008162100B2

(12) United States Patent
Shults et al.

(10) Patent No.: US 8,162,100 B2
(45) Date of Patent: Apr. 24, 2012

(54) FIREARM SOUND SUPPRESSOR

(76) Inventors: Jonathon Shults, Sandy, UT (US); Steven Michael Pappas, Kamas, UT (US); Harrison Holden, Sandy, UT (US)

( * ) Notice: Subject to any disclaimer, the term of this patent is extended or adjusted under 35 U.S.C. 154(b) by 0 days.

(21) Appl. No.: 12/884,598

(22) Filed: Sep. 17, 2010

(65) Prior Publication Data

US 2011/0067950 A1 Mar. 24, 2011

Related U.S. Application Data

(60) Provisional application No. 61/278,810, filed on Oct. 13, 2009, provisional application No. 61/277,024, filed on Sep. 18, 2009.

(51) Int. Cl.
*F41A 21/00* (2006.01)

(52) U.S. Cl. ..... 181/223; 89/14.4

(58) Field of Classification Search ..... 181/223; 89/14.4

See application file for complete search history.

(56) References Cited

U.S. PATENT DOCUMENTS

| | | | | |
|---|---|---|---|---|
| 918,784 | A | 4/1909 | Snow | |
| 5,110,145 | A * | 5/1992 | Stewart | 279/24 |
| 6,948,415 | B2 * | 9/2005 | Matthews et al. | 89/14.4 |
| 7,237,467 | B1 | 7/2007 | Melton | |
| 7,587,969 | B2 * | 9/2009 | Silvers | 89/14.4 |
| 7,588,122 | B2 * | 9/2009 | Brittingham | 181/223 |
| 7,856,914 | B2 * | 12/2010 | Shults et al. | 89/14.4 |
| 7,874,238 | B2 * | 1/2011 | Silvers | 89/14.4 |
| 2008/0271944 | A1 * | 11/2008 | Brittingham | 181/223 |
| 2009/0050403 | A1 * | 2/2009 | Brittingham | 181/223 |

OTHER PUBLICATIONS

International Search Report and Written Opinion for International Application No. PCT/US2010/049262 (mailed Nov. 15, 2010).

* cited by examiner

*Primary Examiner* — Forrest M Phillips
(74) *Attorney, Agent, or Firm* — Ballard Spahr LLP

(57) ABSTRACT

A suppressor for a firearm is provided, wherein the suppressor can be selectively oriented relative to the firearm. The suppressor has an elongate body, a piston assembly and a cam assembly. A piston of the piston assembly can be fixedly attached to the barrel of a firearm. An indexing ring is radially fixed relative to the piston. The cam lever is selectively movable between a second position, in which the indexing ring is fixed relative to the elongate body, and a first position, in which the indexing ring can rotate relative to the elongate body.

18 Claims, 4 Drawing Sheets

FIREARM SOUND SUPPRESSOR

CROSS-REFERENCE TO RELATED APPLICATIONS

This application claims the benefit of priority to U.S. Provisional Application No. 61/277,024, filed Sep. 18, 2009 and U.S. Provisional Application No. 61/278,810, filed Oct. 13, 2009, which are hereby incorporated by this reference in their entireties for all of their teachings.

FIELD OF THE INVENTION

The field of this invention relates generally to the field of sound suppressors/silencers for firearms. More specifically, the field of this invention relates to sound suppressors/silencers for firearms, in which the suppressors/silencers can be selectively oriented relative to the firearm.

BACKGROUND OF THE INVENTION

Firearm silencers are well known in the art of weaponry, and a variety of constructions have been proposed for minimizing the noise associated with expanding gases at the firing of a weapon. One type of silencer construction can be found by reference to U.S. Pat. No. 1,111,202 to W. E. Westfall. Westfall proposes a casing accommodating a plurality of removable funnel-shaped baffle members arranged so that their smaller openings are directed toward the muzzle of the gun muzzle. Outwardly curving faces of the baffle members are purported to act as deflecting surfaces for the exhausting gases. An alternate form of baffle member in a silencer can be found by reference to U.S. Pat. No. 1,482,805 to H. P. Maxim. Maxim uses a similar series of baffle members faced along a cylindrical casing. However, the disc-like portion of each baffle member is constructed of sheet metal having its center hole deformed by offsetting the opposite edges so that the plane of the aperture is inclined to the axis of the casing. With this arrangement, upon firing the gun to which the silencer is attached, the combustion gases are deflected by the deformed portion of the disc-like member and are directed from one chamber to the succeeding one at an angle to a passage for the projectile.

In order to suppress the sound of a firearm, a suppressor must have an internal volume to capture gases emitted from the firearm before releasing the cooled gases to the atmosphere. Typically, the larger the internal volume of the suppressor, the greater amount of sound is suppressed, and so it is desirable to increase the size of the suppressor. However, with conventional concentric, cylindrical suppressors having a desired internal volume, the outer diameter of the suppressor becomes too large and the suppressor can interfere with sight lines of the firearm. Additionally, with conventional concentric, cylindrical suppressors having a desired internal volume, the relatively large outer diameter of the suppressor prevents the firearm from fitting into a holster with the silencer attached.

In view of the preceding, there is a need for a firearm sound suppressor having a desired internal volume that does not obstruct the factory sights of the firearm, and allows the firearm to be holstered without detaching the suppressor.

SUMMARY

This application relates to a suppressor for a firearm, wherein the suppressor can be selectively oriented relative to the firearm. In one aspect, the suppressor comprises an elongate body having a bullet entry end, an opposed bullet exit end, and a longitudinal axis. In one aspect, a bullet pathway can be defined in the elongate body that extends longitudinally though the elongate body from the bullet entry end to the bullet exit end. In another aspect, the bullet pathway can be offset from the longitudinal axis of the elongate body.

In another aspect, the suppressor can comprise a piston assembly that can be rotatably coupled to the elongate body adjacent the bullet entry end of the elongate body. In one aspect, the piston assembly can comprise a piston that is configured for selectively fixed attachment to a distal end of a barrel of the firearm. In still another aspect, the piston assembly can comprise an indexing ring that is coupled to an exterior surface of a proximal end of the piston. Still further, the piston assembly can comprise a spring retainer positioned on the exterior surface of the piston between the indexing ring and a shoulder of the piston, which is defined at the distal end of the piston. In this aspect, a spring can be mounted on the piston between the spring retainer and the shoulder of the piston.

According to one aspect, the indexing ring and spring retainer can be operatively coupled to the piston such that the indexing ring is radially fixed relative to the piston, and the spring retainer is rotatable relative to the piston. Optionally, the indexing ring can be rotatably coupled to the spring retainer. In another aspect, the spring retainer can be configured to be non-rotatably coupled to the bullet entry end of the elongate body.

It one aspect, the suppressor can further comprise a cam assembly. In one exemplary aspect, the cam assembly can comprise a cam lever that is selectively movable about and between a first cam position, in which the cam lever does not apply an engaging force thereon a brake, and a second cam position in which a portion of the cam lever contacts the brake and urges the brake into frictional contact with the indexing ring of the piston assembly. In this aspect, the cam lever can be pivotally mounted on a portion of the bullet entry end of the elongate body. Further, it is contemplated that the brake can overlie a portion of the peripheral surface of the indexing ring and can be configured for axial movement relative to the underlying portion of the peripheral surface of the indexing ring.

In one exemplary aspect, in order to orient the suppressor relative to the firearm after the barrel of the firearm has been selectively fixed to the proximal end of the piston, the cam lever can be moved to the first cam position such that the brake does not frictionally engage the peripheral surface of the indexing ring, and the indexing ring is free to rotate relative to the elongate body. When the desired orientation has been achieved, the cam lever can be selectively moved to the second cam position, thereby urging/moving the brake into frictional contact with the indexing ring, which selectively fixates the indexing ring relative to the elongate body.

DETAILED DESCRIPTION OF THE FIGURES

These and other features of the preferred embodiments of the invention will become more apparent in the detailed description in which reference is made to the appended drawings wherein:

FIG. 1 is a perspective exploded view of a suppressor, according to one aspect.

FIG. 2 is a perspective view of the suppressor of FIG. 1, showing the assembled suppressor having a tube 102 and a back cap 104 of an elongate body 100 of the suppressor removed for clarity.

DETAILED DESCRIPTION OF THE INVENTION

Figure 1:
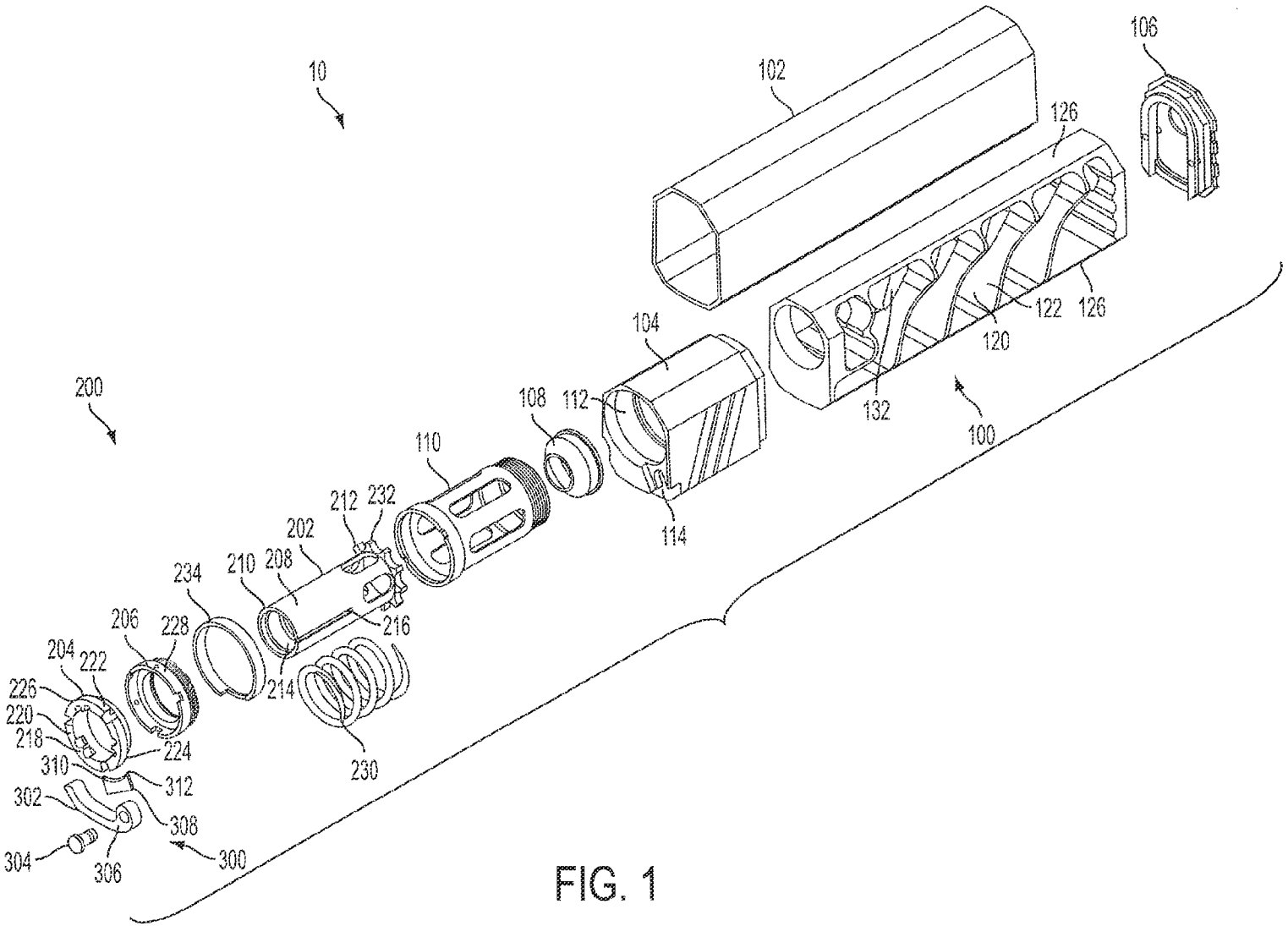
Figure 3:
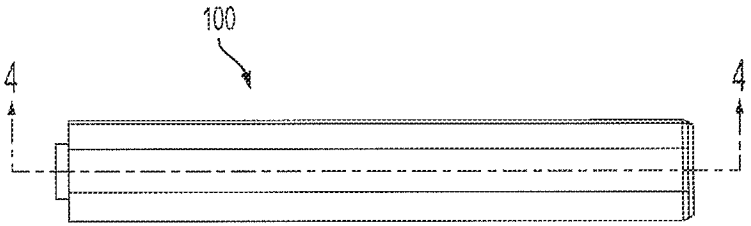
FIG. 3 is a plan view of the assembled suppressor of FIG. 1.
Figure 2:
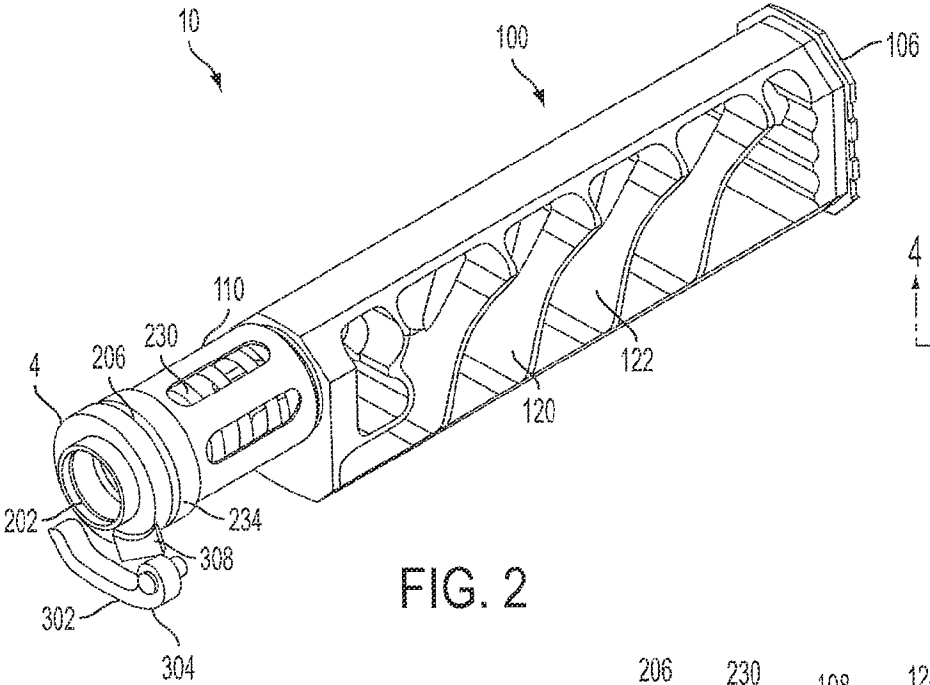

Embodiments of the present invention can be understood more readily by reference to the following detailed description, examples, drawing, and claims, and their previous and following description. However, before the present devices, systems, and/or methods are disclosed and described, it is to be understood that embodiments described herein are not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the invention in its best and currently known embodiments. To this end, those skilled in the relevant art will recognize and appreciate that many changes can be made to the various aspects of the invention described herein, while still obtaining the beneficial results of the described embodiments. It will also be apparent that some of the desired benefits of the embodiments of the present invention can be obtained by selecting some of the features described herein without utilizing other features. Accordingly, those who work in the art will recognize that many modifications and adaptations are possible and can even be desirable in certain circumstances and are a part of the embodiments of the present invention. Thus, the following description is provided as illustrative of the principles of the embodiments of the present invention and not in limitation thereof.

As used throughout, the singular forms "a," "an" and "the" include plural referents unless the context clearly dictates otherwise. Thus, for example, reference to "a bore" can include two or more such bore unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

A device for suppressing noise from a firearm is presented. In one aspect, the device for suppressing noise can be an eccentric suppressor 10 as illustrated in FIGS. 1-6. In another aspect, the suppressor can be selectively fixed or coupled relative to the firearm. In still another aspect, the suppressor can be selectively oriented to a desired orientation relative to the firearm, such that, for example, the suppressor does not interfere with the sights of the firearm.

Figure 4:
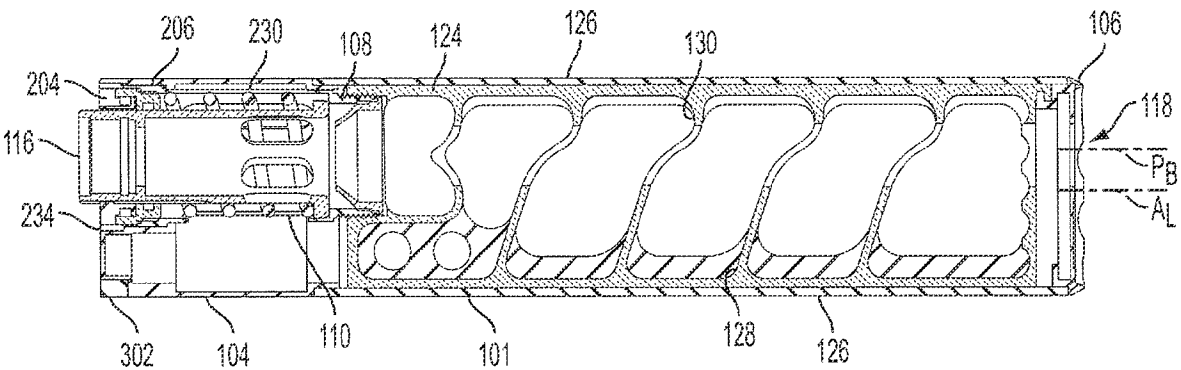
FIG. 4 is a cross-sectional elevational view of the assembled suppressor of FIG. 1, taken along line 4-4 of FIG. 3.
Figure 5:
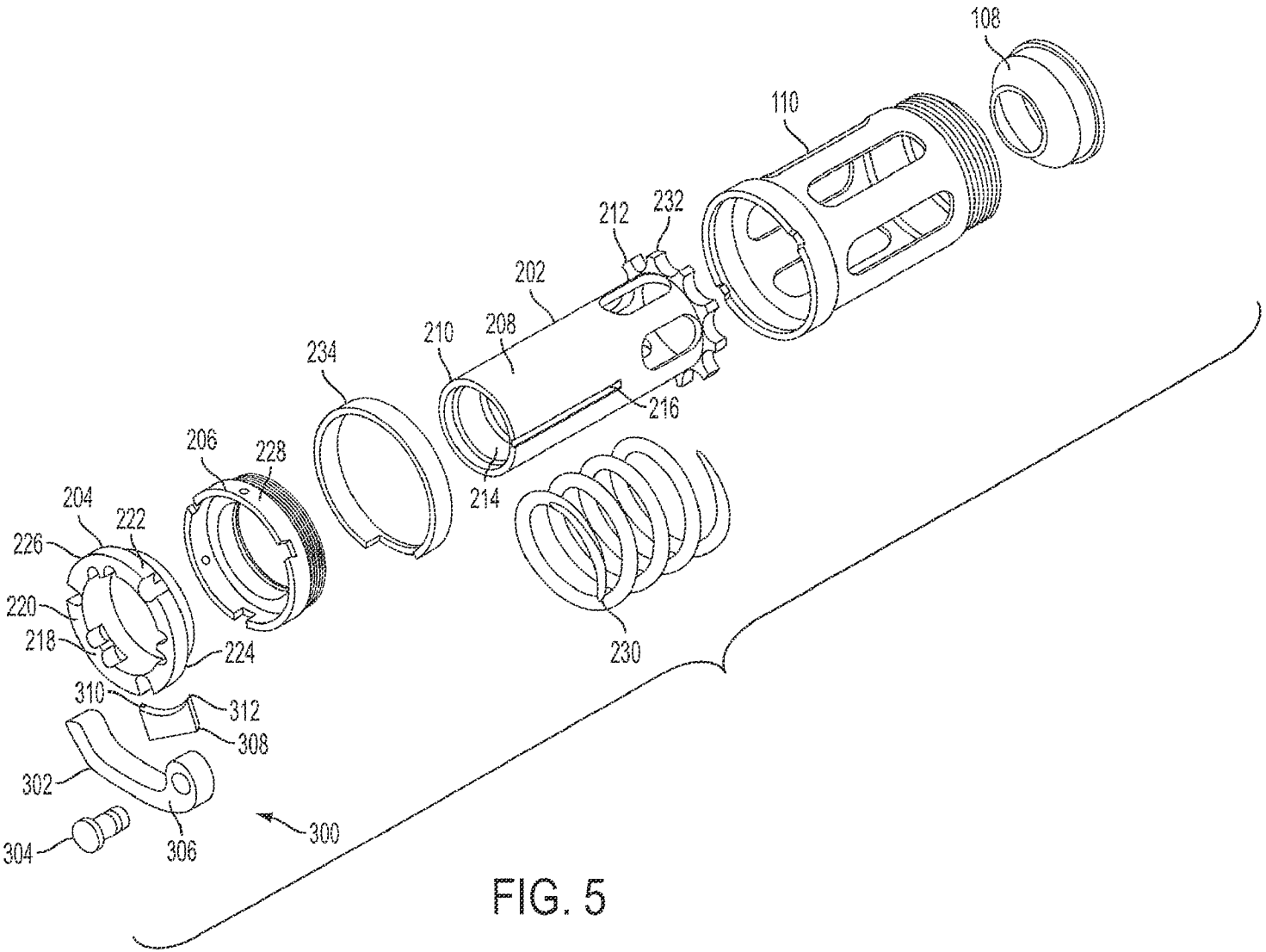
FIG. 5 is a perspective exploded view of a portion of the suppressor of FIG. 1, according to one aspect.
Figure 6:
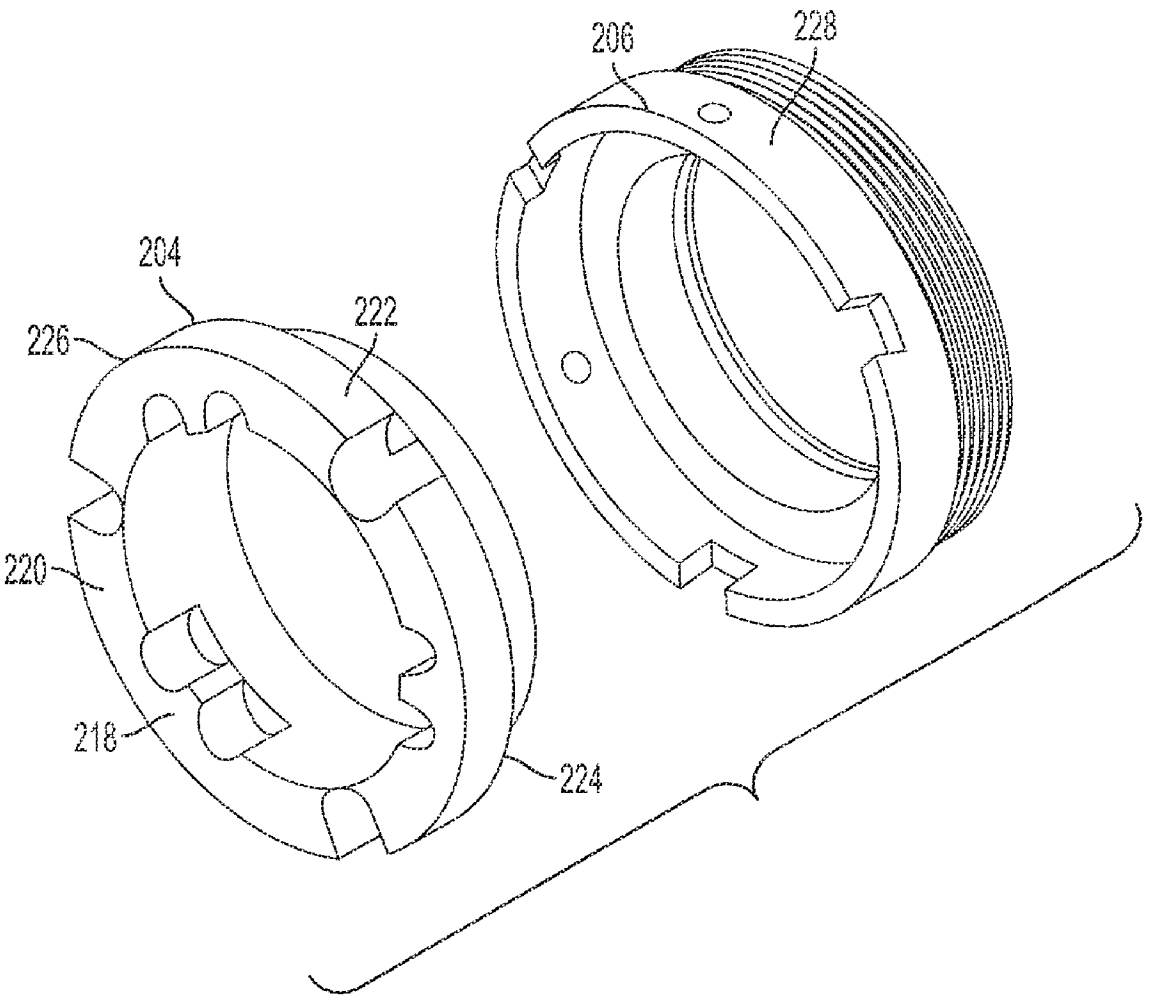
FIG. 6 is a perspective exploded view of an indexing ring and a spring retainer of the suppressor of FIG. 1, according to one aspect

In one aspect, the suppressor 10 comprises an elongate body 100 having a bullet entry end 116 and an opposed bullet exit end 118, as can be seen in FIG. 4. The elongate body 100 defines a bullet pathway $P_B$ that extends longitudinally therethrough the elongate body from the bullet entry end 116 to the bullet exit end 118. In another aspect, the elongate body defines a plurality of adjacent chambers 120 that are spaced along the longitudinal axis $A_L$ of the elongate body. In another aspect, the chambers 120 can be configured to be in fluid communication with each other via a fluid pathway.

In one aspect, the bullet pathway $P_B$ can be substantially co-axially aligned with the longitudinal axis $A_L$ of the elongate body. Alternatively, the bullet pathway $P_B$ can be offset from the longitudinal axis $A_L$. In another aspect, the bullet pathway $P_B$ can be offset from the longitudinal axis $A_L$ by about 1 mm, 2 mm, 3 mm, 4 mm, 5 mm, 6 mm, 7 mm, 8 mm, 9 mm, 10 mm, 12 mm, 14 mm, 16 mm, 18 mm, 20 mm, 25 mm, 30 mm, 35 mm, 40 mm, 45 mm, 50 mm, 60 mm, 70 mm, 80 mm, 90 mm, or about 100 mm. Optionally, the bullet pathway $P_B$ can be offset from the longitudinal axis $A_L$ by at lease 1 mm.

With reference to FIG. 1, in another aspect, a slot 114 can be formed in the bullet entry end 116 of the elongate body 100 of the suppressor 10. In another aspect, the slot can extend from an edge of the elongate body radially towards the center of the elongate body. In one aspect, the slot 114 can be at an acute angle relative to a longitudinal wall 126 of the elongate body. In another aspect, the slot can be substantially perpendicular to a longitudinal wall of the elongate body 100

In one aspect, the suppressor can comprise a piston assembly 200 rotatably coupled to the elongate body 100 adjacent the bullet entry end 116. In another aspect, the piston assembly can be configured to fixedly, selectively attach to a distal end of a barrel of a firearm. As used herein, the terms "fixed" and "fixedly" means substantially non-movably. For example, "fixedly attaching" the piston assembly 200 to the distal end of the barrel of a firearm means that the piston assembly does not substantially move relative to the end of the barrel of the firearm after fixed attachment to the barrel of the firearm, unless the operator selectively removes the suppressor from the firearm.

In another aspect, the piston assembly 200 comprises a piston 202, an indexing ring 204, and a spring retainer 206. The piston, according to one aspect, can comprise an elongate, substantially cylindrical body 208 having a piston bullet entry end 210 and a piston bullet exit end 212. In another aspect, a piston bore 214 can be defined in the piston body that extends from the piston bullet entry end 210 to the piston bullet exit end 212. In another aspect, the piston bore can be substantially coaxially aligned with the bullet pathway. In still another aspect, the piston bullet entry end of the piston can be selectively, fixedly attachable to a portion of the distal end of the barrel of the firearm. Thus, for example and without limitation, at least a portion of the piston bore 214 adjacent the piston bullet entry end 210 can be threaded such that the threads matingly engage complementary threads on the distal end of the barrel of the firearm.

In another aspect, the piston can have at least one longitudinal indexing groove 216 formed on an outer surface of the piston body 208. In another aspect, the at least one indexing groove can extend from the piston bullet entry end 210 towards the piston bullet exit end 212 longitudinally along at least a portion of the piston body 208.

The indexing ring 204 can be an annular indexing ring having an inner diameter sized to correspond to an outer diameter of the piston 202, such that the indexing ring can fit around the piston with close tolerance. In one aspect, the indexing ring can be configured for coupling to the piston bullet entry end 210 of the piston. In another aspect, the inner diameter of the indexing ring can have at least one longitudinal indexing tab 218 formed thereon. In another aspect, the at least one indexing tab can extend longitudinally from a first side 220 of the indexing ring to a second side 222. Alternatively, in another aspect, the at least one indexing tab 218 can extend longitudinally for a portion of the distance from the first side 220 of the indexing ring to the second side.

In operation, when the indexing ring 204 is inserted around the piston 202 such that the at least one indexing tab of the indexing ring is inserted in the at least one indexing groove 216 of the piston, as described more fully below, the indexing ring can be substantially radially fixed relative to the piston body 208. Thus, in one aspect, the indexing ring 204 can be free to move longitudinally axially along the at least one indexing groove a predetermined distance, however, the indexing ring can be prevented from rotating relative to the piston 202. In this manner, the indexing ring can be radially fixed with respect to the piston. It is of course contemplated that other means for radially fixing the indexing ring 204 to the piston can be used, such as for example and without limitation, a rail and slot arrangement.

In one aspect, the indexing ring 204 comprises a frictional aid 224 configured to increase frictional forces with a brake 308, described below. In another aspect, the frictional aid can be positioned on or formed integrally with an outer surface 226 of the indexing ring. In still another aspect, the frictional aid can comprise a plurality of longitudinal and/or diagonal grooves formed in the peripheral surface of the indexing ring. In another example, the frictional aid can comprise a material having a relatively high coefficient of friction, such as for example and without limitation, knurled rubber and the like.

The spring retainer 206 can be an annular spring retainer configured for fixed attachment to the elongate body 100 of the suppressor 10. In one aspect, a portion of an outer surface 228 of the spring retainer can be configured for fixed attachment to the elongate body. In another aspect, a portion of the outer surface of the spring retainer can be threaded such that the threads matingly engage complementary threads formed on an inner diameter of the bore 112 proximate the bullet entry end 116 of the elongate body 100.

In one aspect, the spring retainer 206 can have an inner diameter sized to correspond to the outer diameter of the piston, such that the spring retainer can fit around the body 208 of the piston with close tolerance. In another aspect, the spring retainer can define a groove configured for receiving an o-ring therein. In another aspect, the spring retainer can be formed without tabs and the like so that the spring retainer can be free to rotate relative to the piston 202 and move longitudinally along the piston. In still another aspect, the spring retainer 206 can be rotatably coupled to the indexing ring 204. In this aspect, the spring retainer and the indexing ring can be coupled to each other so that the spring retainer can rotate relative to the indexing ring. Thus, after the indexing ring and spring retainer 206 have been installed on the piston, as described more fully below, the spring retainer can both rotate radially and move longitudinally relative to the piston 202 while being fixed radially and longitudinally relative to the elongate body 100 of the suppressor 10.

In one aspect, the suppressor comprises a cam assembly 300 comprising a cam lever 302, a brake 308, and a cam bolt 304. In one aspect, the brake can be positioned in a portion of the bullet entry end 116 of the elongate body 100. In this aspect, the brake can be configured to be mounted for axial movement therein the slot 114 formed in the bullet entry end 116 of the elongate body 100. In one aspect, the brake can have a braking surface configured to frictionally engage a portion of the indexing ring 204 that underlies the braking surface. In another aspect, the brake can have an arcuate braking surface 310 configured to frictionally engage the indexing ring 204. In this aspect, it is contemplated that the arcuate braking surface can have a radial curvature substantially equal to the radial curvature of the indexing ring.

In still another aspect, at least a portion of the arcuate braking surface 310 of the brake 308 can comprise a brake frictional aid 312 configured to increase frictional forces with the indexing ring. In another aspect, the brake frictional aid can be positioned on or formed integrally with the arcuate braking surface. In still another aspect, the brake frictional aid 312 can comprise a plurality of longitudinal and/or diagonal grooves formed in at least a portion of the arcuate braking surface 310. In another example, the brake frictional aid can comprise a material having a relatively high coefficient of friction, such as for example and without limitation, knurled rubber and the like. Optionally, the brake frictional aid can be any selected texture formed therein the braking surface. In this aspect, it is contemplated that the selected surface can complementarily fit or otherwise engage a textured surface formed on the peripheral surface of the indexing ring 204.

In one aspect, the brake 308 can be positioned in the slot 114 formed in the bullet entry end 116 of the elongate body 100 of the suppressor 10 for axial movement therein. As one will appreciate, the brake is also positioned to overlie a portion of the peripheral surface of the indexing ring. When positioned in the slot, the brake can be movable radially between a first brake position a first predetermined radial distance away from the longitudinal axis of the elongate body, and a second brake position a second predetermined radial distance away from the longitudinal axis of the elongate body. In one aspect, the second predetermined radial distance can be less than the first predetermined radial distance. In this aspect, it is contemplated that the second predetermined radial distance is less than the radius of the piston bore. Thus, when fully assembled, as described below, according to one aspect, in the first brake position, the brake 308 does not engage the peripheral surface of the indexing ring 204, while in the second brake position, at least a portion of the arcuate braking surface 310 of the brake 308 can be urged or otherwise forced into frictionally engagement with a portion of the peripheral surface of the indexing ring that underlies the braking surface.

The cam bolt 304 can extend through a bore 306 in the cam lever 302 to attach the cam lever to the elongate body 100 of the suppressor 10. In one aspect, the cam lever can be selectively movable about and between a first cam lever position, in which the cam lever 302 does not urge or otherwise force the brake 308 into frictional engagement with the indexing ring, and a second cam lever position, in which a portion of the cam lever contacts the brake and urges the brake to move from the first brake position to the second brake position.

Optionally, the cam assembly 300 can operatively engage the indexing ring 204 via other alternative embodiments. For example, the cam lever 302 can be configured to engage the indexing ring directly without requiring a brake. In another example, the cam lever and/or the brake 308 can be configured to urge the indexing ring to move longitudinally and/or axially into a stationary surface, such as an inner wall of the elongate body 100. In this aspect, the stationary surface can be configured to frictionally engage the indexing ring 204, which operatively prevents the indexing ring from rotating freely.

In one aspect, the piston assembly 200 can comprise a spring 230 positioned between the piston bullet entry end 210 and the piston bullet exit end 212. In another aspect, the spring can be positioned on the exterior surface of the piston therebetween the spring retainer 206 and a spring shoulder 232 that is formed on the piston bullet exit end. In still another aspect, the spring can be configured to urge the indexing ring longitudinally away from the piston bullet exit end 212. In use, the spring 230 can allow the elongate body 100 to move slightly independently of the piston 202 and the firearm, thereby aiding in unlocking of the firearm barrel, as known in the art.

As can be seen in the figures, the elongate body 100 of the suppressor 10 can comprise a blast baffle 108 and a plurality of spaced chamber baffles 122 separating each of the chambers. Each chamber baffle defines a baffle aperture 132 that is coaxial with the bullet pathway $P_B$. In one aspect, at least a portion of at least one of the chamber baffles 122 can be positioned to lie in a plane that is substantially transverse to the bullet pathway. The elongate body 100 can comprise at least two longitudinal walls 126 that extend from the bullet entry end 116 to the bullet exit end 118. In this aspect, each of the chamber baffles 122 are connected to and supported by at least one of the longitudinal walls 126.

In another aspect, the elongate body 100 can comprise at least one of a tube 102, a back cap 104, a front cap 106, and an encapsulator 110. As can be appreciated, the tube, the back cap, and the front cap can form a housing in which the other components of the suppressor 10 can be positioned. In one aspect, as previously discussed, the back cap 104 can define a bore 112 having an inner diameter that can be threaded or otherwise configured to matingly engage the outer diameter of the spring retainer 206. Additionally, the back cap can define a bore configured to receive the cam bolt 304, and a slot 114 configured to receive the brake 308.

In one aspect, at least a portion of at least one of the chamber baffles 122 can be substantially frustoconical in shape. In another aspect, at least a portion of at least one of the chamber baffles can be positioned at an acute angle relative to the bullet pathway $P_B$. As illustrated in FIG. 4, at least a portion of the chamber baffles 122 can be arcuate in shape. In one aspect, the first baffle 124 downstream (relative to the bullet pathway) from the blast baffle 108 can be an arcuate "V" or "M" shape. In another aspect, at least one of the chamber baffles downstream from the first baffle can be substantially arcuate in shape, having a first connection point 128 at a longitudinal wall 126 that is upstream of a second connection point 130 relative to the bullet pathway $P_B$. It should be noted that many other shapes are contemplated for the chamber baffles 122, such as, for example and without limitation, a pyramid, a wafer, and the like.

As illustrated in FIG. 1, a cross-sectional view of the outer surface of the suppressor 10 can be substantially octagonal, according to one aspect. However, the suppressor can have other cross-sectional shapes as well, such as substantially circular, substantially rectangular, substantially oval, and the like. In one aspect, the cross-sectional shape can be selected to correspond to the shape of the barrel of at least one firearm and/or firearm holster. In this aspect, the suppressor 10 can be holstered in a firearm holster, as a firearm would be, without requiring removal of the suppressor from the firearm.

As one skilled in the art will appreciate, the suppressor 10 is configured to attach to the muzzle of a firearm such that the bullet pathway is substantially co-axially aligned with the trajectory of the bullet as it exits the muzzle of the firearm. When the bullet exits the muzzle, it exits along with high velocity discharge gases that, in normal operation, exit the muzzle rapidly, which causes a loud noise. Noise suppressors, such as the one presented, are designed to dissipate the discharge gases that exit the muzzle of a firearm to reduce the level of noise being emitted. In the present suppressor 10, these discharge gases are dissipated via the adjacent chambers 120.

In one aspect, as previously discussed, the elongate body can comprise at least one elongate tube 102 configured to selectively substantially envelop the elongate body and substantially enclose each of the adjacent chambers. The elongate tube can be formed from one piece; however it is contemplated that the elongate tube can be formed from two or more pieces configured to matingly engage each other. If the elongate tube 102 is formed from two or more pieces, longitudinal edges of the pieces can be keyed to compliment each other, or they may just abut one another. It is also contemplated that at least one of the pairs of longitudinal edges can comprise a hinge or similar fastening device. In one aspect, the elongate tube 102 of the elongate body 100 can be configured to be easily removed so that that the deposits caused by build-up of carbon and lead from the discharge gases can readily be accessed and removed. Alternatively, in another aspect, the elongate tube 102 can be configured to be substantially permanently attached to the elongate body to prevent a user from easily accessing internal elements of the elongate body.

Additionally, in one aspect, at least a portion of the suppressor 10 can be formed from aluminum. However, other materials are also contemplated, such as, for example and not meant to be limiting, alloy steel, titanium, stainless steel, carbon fiber, other reinforced composite materials, and the like.

To assemble one embodiment of the suppressor 10, the piston assembly 200 can first be assembled by inserting the spring 230 around the piston 202 until the spring is seated on the shoulder 232 of the piston. The spring retainer 206 can be rotatably coupled to the indexing ring 204 so that the spring retainer can rotate relative to the indexing ring. The at least one indexing tab 218 of the indexing ring can be aligned with the at least one indexing groove 216 of the piston 202, and the indexing ring/spring retainer can slide onto the piston bullet entry end 210. This allows the indexing ring/spring retainer to move longitudinally along the piston body 208, while preventing radial movement of the indexing ring 204.

In one aspect, the elongate body 100 can be formed from at least one of the tube 102, the back cap 104, the front cap 106, the encapsulator 110, and the blast baffle 108. The cam assembly 300 can be assembled by positioning the brake 308 in the slot 114 in the elongate body 100, and rotatably attaching the cam lever 302 to the elongate body with the cam bolt 304. The piston assembly 200 can be inserted into the bore 112 of the elongate body, and the indexing ring 204 can be selectively fixedly attached to the elongate body 100 by, for example, engaging the threads on the outer diameter of the spring retainer with the mating threads of the bore of the elongate body.

In operation, to selective mount the suppressor to the firearm, the cam lever 302 can be urged to the second cam position. As the cam lever is moved towards the second cam position, the cam lever 302 contacts the brake 308 and begins to urge the brake from the first brake position towards the indexing ring. As the cam lever moves toward the second cam position, the brake is moved towards the second brake position, whereby the arcuate braking surface 310 of the brake is in frictional engagement with the indexing ring 204. When the cam lever is in the second cam position, the brake is in the second brake position and the indexing ring is frictionally held in its position and restricted from moving radially or longitudinally relative to the elongate body 100. The suppressor 10 can then be selectively fixedly attached to a firearm by for example, engaging the threads on the inner diameter of the piston bullet entry end 210 of the piston 202 with mating threads of the barrel of the firearm.

It is likely that upon attaching the suppressor 10 to the firearm, the suppressor will not be oriented in a desired orientation with respect to the connect firearm. Upon the operative coupling of the piston 202 and firearm, the piston and firearm are fixed relative to each other. To selective fix the relative orientation of the suppressor 10 relative to the firearm after the barrel of the firearm has been selectively fixed thereto the piston bullet entry end 210 of the piston, the cam lever 302 can be moved from the second cam position to the first cam position, in which the cam lever does not operatively contact the brake 308 so that the brake moves from the second brake position towards the first brake position, in which the arcuate braking surface 310 of the brake does not contact the indexing ring 204. This allows the elongate body 100 to be rotated with respect to the indexing ring 204 about the longitudinal axis of the piston. One will appreciate that, in the described position, the elongate body can be rotated with respect to the piston and the firearm without disturbing the selective coupled engagement of the piston and the barrel of the firearm and the engagement of spring retainer 206 and the elongate body. In operation, the user can rotate the elongate body to the desired orientation relative to the firearm. This operator induced rotation causes the spring retainer to rotate relative to the indexing ring 204, but does not require loosening any of the fixed attachments. After orienting the elongate body 100 as desired, the user can move the cam lever 302 back to the second cam position to selectively lock the elongate body in the desired selected orientation relative to the firearm.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A suppressor for a firearm, comprising:

an elongate body having a bullet entry end, an opposed bullet exit end, and a longitudinal axis, wherein the elongate body defines a bullet pathway extending longitudinally therethrough from the bullet entry end to the bullet exit end;

a piston assembly rotatably coupled to the elongate body adjacent the bullet entry end configured to fixedly attach to a barrel of the firearm, wherein the piston assembly comprises a piston, an indexing ring attached to the piston at a piston bullet entry end and an annular spring retainer rotatably coupled to the indexing ring, wherein the indexing ring is radially fixed relative to the piston, wherein the spring retainer is rotatable relative to the piston, wherein the spring retainer is fixed relative to the elongate body, wherein an exterior surface of the spring retainer is threaded, and wherein the exterior threads of the spring retainer matingly engage corresponding threads on an inner diameter of the elongate body; and means for selectively orienting and selectively fixing the elongate body relative to the piston assembly, wherein the means comprises a cam assembly.

2. The suppressor of claim 1, wherein the cam assembly comprises a cam lever and a brake in operative communication with the cam lever, and wherein the cam lever is selectively movable about and between a first cam position, in which the cam lever is spaced from the brake, and a second cam position, in which a portion of the cam lever contacts the brake and urges the brake into frictional contact with a portion of the indexing ring.

3. The suppressor of claim 1, wherein the piston has a piston bullet exit end, wherein the piston defines a piston bore that is coaxial with the bullet pathway, and wherein the piston bullet entry end is selectively, fixedly attachable to the barrel of the firearm.

4. The suppressor of claim 1, wherein the bullet pathway is offset from the longitudinal axis of the elongate body.

5. The suppressor of claim 1, wherein the piston has at least one longitudinal indexing groove, and wherein the indexing ring has at least one indexing tab configured to engage the indexing groove of the piston.

6. The suppressor of claim 1, further comprising a spring positioned between the piston bullet entry end and the piston bullet exit end, wherein the spring is configured to urge the indexing ring longitudinally away from the piston bullet exit end.

7. The suppressor of claim 1, wherein the indexing ring comprises a frictional aid.

8. The suppressor of claim 7, wherein the frictional aid comprises a plurality of grooves.

9. The suppressor of claim 7, wherein the frictional aid comprises knurled rubber.

10. The suppressor of claim 1, wherein the elongate body further comprises a plurality of spaced baffles that extend across the bullet pathway, wherein each baffle defines a baffle aperture that is coaxial with the bullet pathway, and wherein the plurality of spaced baffles of the elongate body defines a plurality of adjacent chambers spaced along the longitudinal axis of the elongate body.

11. The suppressor of claim 10, wherein each baffle substantially separates the adjacent chambers.

12. The suppressor of claim 10, wherein at least a portion of at least one of the baffles lies in a plane that is transverse to the bullet pathway.

13. The suppressor of claim 10, wherein at least a portion of at least one of the baffles is at an acute angle relative to the bullet pathway.

14. The suppressor of claim 1, wherein the elongate body is substantially rectangular in cross-sectional shape.

15. The suppressor of claim 1, wherein the elongate body is substantially octagonal in cross-sectional shape.

16. The suppressor of claim 1, wherein the elongate body comprises aluminum.

17. The suppressor of claim 1, wherein the elongate body comprises carbon fiber.

18. A suppressor for a firearm, comprising:

an elongate body having a bullet entry end, an opposed bullet exit end, and a longitudinal axis, wherein the elongate body defines a bullet pathway extending longitudinally therethrough from the bullet entry end to the bullet exit end;

a piston assembly rotatably coupled to the elongate body adjacent the bullet entry end configured to fixedly attach to a barrel of the firearm, wherein the piston assembly has a piston bullet entry end and a piston bullet exit end, wherein the piston assembly comprises a piston, an indexing ring attached to the piston at the piston bullet entry end, an annular spring retainer rotatably coupled to the indexing ring, and a spring positioned around at least a portion of the piston between the piston bullet entry end and the piston bullet exit end, wherein the indexing ring is radially fixed relative to the piston, wherein the spring retainer is rotatable relative to the piston, wherein the spring retainer is fixed relative to the elongate body, and wherein the spring retainer is positioned intermediate the spring and the indexing ring; and means for selectively orienting and selectively fixing the elongate body relative to the piston assembly, wherein the means comprises a cam assembly.

* * * * *